United States Patent [19]

Davies et al.

[11] 4,449,259

[45] May 22, 1984

[54] FLUSH TANK METERING DEVICE

[76] Inventors: Evan Davies, 1130 SW. 6 St., Fort Lauderdale, Fla. 33312; John C. Marmon, Jr., 2597 Hinda Rd., Lake Park, Fla. 33403

[21] Appl. No.: 414,892

[22] Filed: Sep. 3, 1982

[51] Int. Cl.[3] ..... E03D 1/00

[52] U.S. Cl. ..... 4/415

[58] Field of Search ..... 4/415, 353, 363, 364, 4/345, 346, 226, 661, 225

[56] References Cited

U.S. PATENT DOCUMENTS

| | | | |
|---|---|---|---|
| 2,761,151 | 9/1956 | Ferrando | 4/225 |
| 2,807,024 | 9/1957 | Kapp | 4/353 |
| 4,110,849 | 9/1978 | La Faver | 4/415 X |
| 4,221,010 | 9/1980 | Young | 4/363 |

*Primary Examiner*—Charles E. Phillips

*Attorney, Agent, or Firm*—Malin, Haley & McHale

[57] ABSTRACT

A metering device in the form of an article to regulate by metering the amount of water used to fill the trap in the toilet bowl through the vent tube of a toilet bowl flush tank during a complete flushing and filling cycle of the toilet bowl and the flush tank. The metering device eliminates waste of water by metering the amount of water entering the trap through the vent tube and saving excess water by depositing the excess water into the flush tank for use during the next flush cycle. The metering device is a one piece metering device with a smaller metering opening that is dropped into position in the vent tube in the flush tank. The metered water seals off the toilet bowl trap and the additional water is dispensed from the metering device and allowed to overflow into the flush tank.

1 Claim, 4 Drawing Figures

FLUSH TANK METERING DEVICE

BACKGROUND OF THE INVENTION

This invention relates to an article for a toilet flush tank to regulate the water received into the toilet bowl trap after flushing and thereby inhibits excesses of water from being wasted automatically after the flush. The excess water is overflowed into the flush tank for use during the next flush. A prior art device is disclosed in U.S. Pat. No. 4,221,010.

The present invention overcomes the problem of wasting water during the flushing operations by use of a metering device that requires no special seals, valves, controlling tubes or sphyons.

It is an object of this invention to provide a unitary metering device for saving water passed through the vent tube of a toilet bowl flush tank.

It is an object of this invention to provide an article for saving water passed through the vent tube.

It is another object of this invention to provide a low cost device to save approximately two gallons of water per flush.

In accordance with these and other objects which will be apparent hereinafter, the instant invention will now be described with particular reference to the accompanying drawings.

SUMMARY OF THE INVENTION

A metering device to regulate the amount of water used to fill the trap in the toilet bowl through the vent tube in the flush tank and to distribute excess water by overflow into the closed flush tank to save the water during refilling cycle of flushing cycle. The metering device eliminates waste of water by metering a lesser amount of water entering the trap of the toilet bowl through the vent tube of the flush tank. The metering device is an article without moving parts. The metering device is a one piece tube with a smaller metering opening in the bottom of the tube. The metering device is dropped into position in the vent tube in the flush tank. The tube has a top that holds the metering tube in position and at the time directs excess water into the flush tank of the toilet bowl over the top.

The metered water insures that there is a water seal in the trap of the toilet bowl and allows water to wash the sides of the bowl but eliminates waste. The additional water not dispensed from the opening in the bottom of the metering device overflows to aid in filling the flush tank for the next flush.

In accordance with these and other objects which will be apparent hereinafter, the instant invention will now be described with particular reference to the accompanying drawings.

DESCRIPTION OF THE PREFERRED EMBODIMENT

Figure 1:
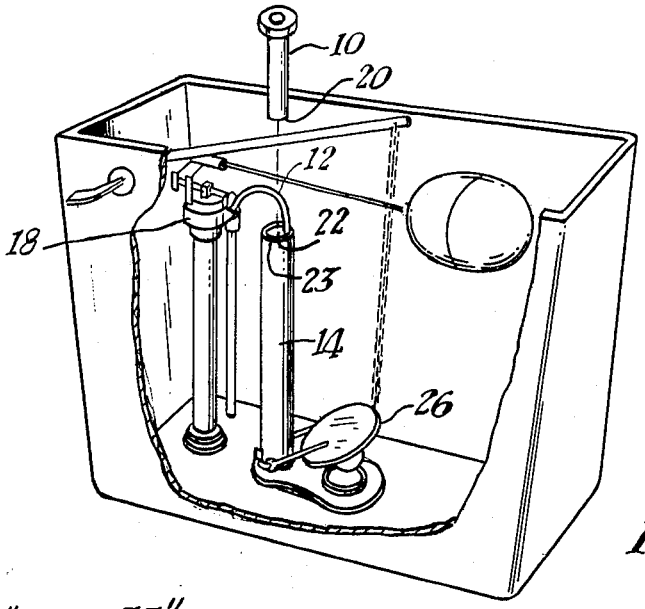
FIG. 1 is an isometric view illustrating the metering device being inserted in a flush tank.

This invention relates to an article 10 a metering device used to regulate the amount of water passing through tube 12 to fill the trap in the toilet bowl (not shown) through the vent tube 14 during a complete flushing and refilling of the flush tank 16. The article or metering device 10 eliminates waste of water by metering the amount of water from valve 18 of an ordinary flush tank from entering the trap in a toilet bowl (of ordinary common design) through the vent tube 14 of a particular flush tank. The article or metering device 10 is a one piece article with a smaller opening in the bottom 20 that is dropped into position through the top 22 of the vent tube in the tank. The smaller opening in bottom 20 allows enough water into toilet bowl to fill the trap and at the time allows excess water to be expelled over the top 24 into the flush tank of the toilet. The metered water flowing through the bottom 20 seals off the toilet bowl trap. The additional water not dispensed from the opening in the bottom 20 of the metering device 10 overflows into the flush tank when seal 26 is closed to aid in filling the flush tank 16 for the next flushing cycle.

Figure 3:
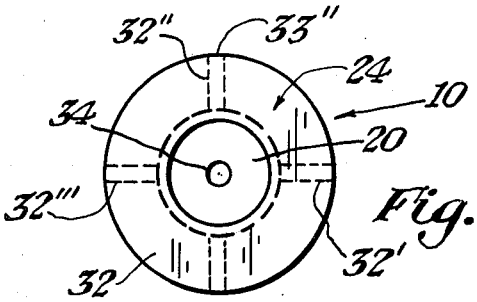
FIG. 3 is a top view of the metering device.
Figure 2:
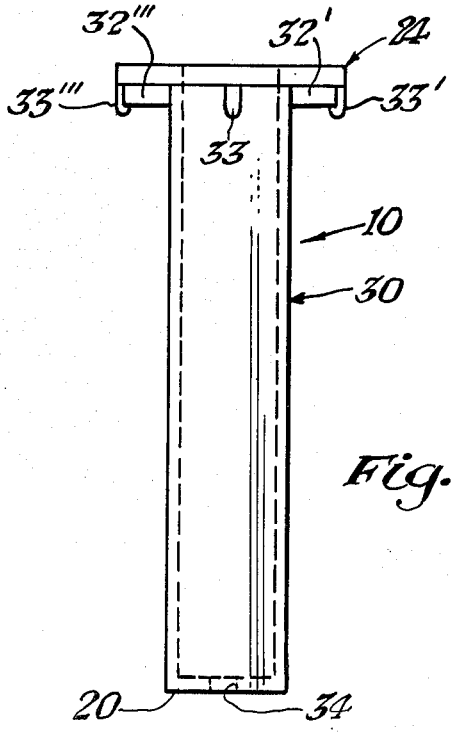
FIG. 2 is a side view of the metering tube.

Referring now to FIGS. 2 and 3 the metering device 10 has a tubular body 30 just under four inches long of three quarters of an inch in outside diameter. The metering device has a top 24 that allows the metering device to cover the opening 22 in FIG. 1 in the vent tube 14. The ridges 32, 32', 32" and 32"' or bumps 33, 33', 33" and 33"' raise the top or cover 24 off the entrance ridge 23 of the inlet 22 into the vent tube 14. This allows the vent tube to act as a safety drain for allowing excess water to escape, such as excess water that may be placed in the flush tank because of leaks in the flushing system. This arrangement prevents water from overflowing the flush tank 16 onto the floor. The bumps may be positioned outside of the perimeter of the ridge 23 of the inlet 22 to further secure the metering device in place.

The top is one and one half inches in diameter. The metering opening 34 in the bottom 20 is one sixteenth of an inch in diameter. The wall thickness of the body is one sixteenth of an inch in thickness.

Figure 4:
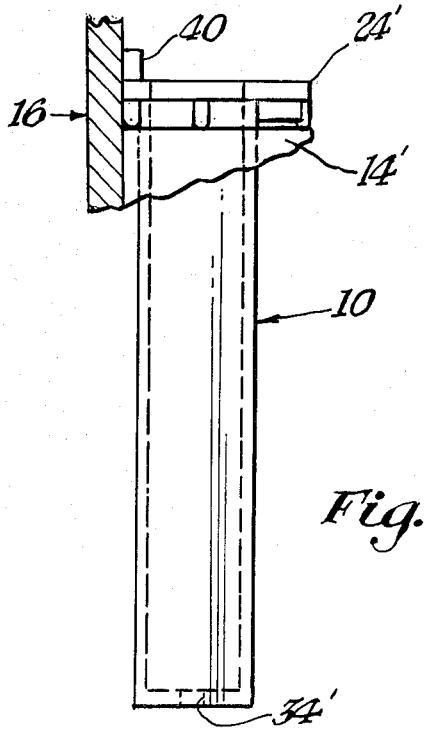
FIG. 4 is a side view of another embodiment of the metering tube.

Referring to FIG. 4, is another embodiment of the invention. If, as in some, flush tanks, the vent tube is molded in as one part of one side wall of the flush tank, the metering device 10 will not fit because of the design of the top 24 shown in FIG. 2. FIG. 4 shows a metering device 10', a top 24' that has a raised portion 40 that is placed against the wall 42 of the tank 16'. The top 24' has ridges and bumps that make contact with the top 42 of the vent tube 14'. The shortened top 24' with portion 40 allows the metering tube 10' to be inserted and allows the metering tube 10' to function just as the one described above.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An insertable flush tank water metering device for a conventional flush tank type toilet with a generally vertical vent tube in fluid communication with a toilet bowl trap, and a filler water tube for dispensing filler water connected to said vent tube, comprising:

a stationary conduit metering means having an upper means for causing excess filler water to aid in filling the flush tank, and lower means for measuring water to the toilet bowl trap, said metering means constructed and arranged for inserting into the vent tube for receiving and metering of a selected quantity of filler water from the filler water tube to fill the toilet bowl trap and for causing any excess quantity of filler water received into the vent tube to overflow out of the vent tube into the flush tank as a result of metering a lesser amount of filler water out said lower means of said metering means during refilling of the toilet bowl trap and holding means for holding stationary said conduit metering means within said vent tube, said metering means is a conduit with an upper inlet; said upper means is a flange connected around said inlet; said lower means is an aperture smaller than said inlet; and said holding means includes said inlet and said flange provides direct access of flush tank water to overflow into the vent tube.

* * * * *